US005846110A

United States Patent [19]

Kanagu et al.

[11] Patent Number: 5,846,110

[45] Date of Patent: Dec. 8, 1998

[54] METHOD OF MANUFACTURING PLASMA DISPLAY PANELS WITH CONVEX SURFACE

[75] Inventors: Shinji Kanagu; Masashi Amatsu, both of Kawasaki, Japan

[73] Assignee: Fujitsu Limited, Kawasaki, Japan

[21] Appl. No.: 619,243

[22] Filed: Mar. 21, 1996

[30] Foreign Application Priority Data

Jun. 30, 1995 [JP] Japan ..... 7-165775

[51] Int. Cl.[6] ..... H01J 9/26

[52] U.S. Cl. ..... 445/25

[58] Field of Search ..... 445/24, 25

[56] References Cited

U.S. PATENT DOCUMENTS

| | | | |
|---|---|---|---|
| 4,139,250 | 2/1979 | Jacobs et al. | 445/25 |
| 4,728,309 | 3/1988 | Baeger | 445/25 |
| 5,273,475 | 12/1993 | Oshikawa | 445/25 X |
| 5,632,663 | 5/1997 | Ishihara et al. | 445/25 |

*Primary Examiner*—Kenneth J. Ramsey
*Attorney, Agent, or Firm*—Staas & Halsey

[57] ABSTRACT

Front substrate and back substrate of a PDP are respectively in a warped state such that a central portion of each substrate projects more frontwards than peripheral portions of the respective substrate, so that the front surface is convex. A stress remains in the substrates such that the two substrates are pressed to each other with an elastic deformation.

In preparing the two substrates, the front panel and back panel are respectively warped towards each other so that the facing inner surfaces are convex in being sealed with each other. A height difference ratio of the central portion from a central part of a short side of the back substrate is preferably less than 0.16%. A height difference ratio of the central portion from a central part of a short side of the front substrate is preferably less than 0.06%. Difference of the height difference ratios of the back substrate and the front substrate is preferably 0 to 0.1 point.

28 Claims, 11 Drawing Sheets

HEATING

HEATING

COOLING

HEATING

COOLING

COOLING

| | PREPARED PANELS | | | | | SEALED PANELS | | |
|---|---|---|---|---|---|---|---|---|
| | THE HIGHEST h2 OR h5 | | | | | | | |
| SAMPLE | FRONT PANEL | | BACK PANEL | | DIFF. | PANEL | WARP | DISCHARGE |
| | μm | % | μm | % | pt. | | % | |
| 1-1 | 390 | 0.08 | 860 | 0.20 | 0.12 | CRACKED | | |
| 1-2 | 100 | 0.02 | 880 | 0.20 | 0.18 | CRACKED | | |
| 1-3 | 50 | 0.01 | 900 | 0.20 | 0.19 | CRACKED | | |
| 2-1 | 518 | 0.11 | 690 | 0.16 | 0.05 | CRACKED | | |
| 2-2 | 575 | 0.13 | 733 | 0.17 | 0.08 | CRACKED | | |
| 3-1 | 260 | 0.06 | 700 | 0.16 | 0.10 | NO CRACK | 0.10 | OK |
| 3-2 | 280 | 0.06 | 570 | 0.13 | 0.07 | NO CRACK | 0.07 | OK |
| 3-3 | 270 | 0.06 | 520 | 0.12 | 0.06 | NO CRACK | 0.06 | OK |
| 3-4 | 230 | 0.05 | 184 | 0.04 | -0.01 | NO CRACK | -0.01 | NG |

METHOD OF MANUFACTURING PLASMA DISPLAY PANELS WITH CONVEX SURFACE

BACKGROUND OF THE INVENTION

1. Field of the invention

This invention relates to a Plasma Display Panel, hereinafter referred to as a PDP, which is a kind of thin display devices.

2. Description of the Related Arts

PDPs excel in the visual sensation because PDPs are of a self-luminescent type, and is comparatively easy to accomplish a large and high-speed display which suits television displays. Especially, surface discharge type PDPs are suitable for a color display by the use of fluorescent materials.

Large screen size is one of demands from the market for the PDP. In order to satisfy this demand, the development of the structure and the PDP manufacturing method suitable for a large panel has been progressing.

PDPs have discharge spaces therein arranged on a substantially flat plane. The panel envelope to form the external outline is provided by a pair of substrates opposed from each other via the discharge space. At least the substrate on the front side must be transparent. Soda lime glass plates are usually used for the substrates on the front side and the back side.

In a PDP display method where a lot of discharge cells arranged in a matrix emit lights selectively, there are separator walls, which are often called ribs, to define the discharge spaces.

The height of the separator walls is equal to the gap clearance of the discharge spaces. For instance, in a surface discharge type PDP where the display electrodes to form the discharge electrode pairs are arranged in mutually adjacent and parallel relationship, the separator walls lie straight on a plane and are provided at equal intervals in the direction of the line of the display, i.e. in the direction along which the display electrodes extend. Spread of the discharge is limited by the separator walls, whereby discrete discharge cells are defined. Accordingly, an accurate matrix display is accomplished.

Moreover, the separator walls play the role of distance pieces, i.e., spacers, to provide equal gap clearance of the discharge spaces all over the display area, in which an unequal clearance may affect the discharge condition.

The manufacturing process of a PDP is divided roughly into three processes. That is, PDP is completed after sequentially undergoing a process by which predetermined composition elements are formed on each substrate so as to make the front panel and the back panel, a process in which the front panel, and the back panel thus made respectively in this manner, are combined (sealed) with each other, and a process to fill a discharge gas therein after cleaning the inside. Usually, the front panel and the back panel are manufactured in parallel.

Main composition elements in surface discharge type PDPs are, for example, display electrodes, a dielectric layer for the AC drive, a dielectric layer protection film, electrodes for addressing the discharge cell to be lit, separator walls, and fluorescent material layers.

The formation of these composition elements accompanies heat processes. For example, in forming the display electrodes, the substrate is heated at a sputtering or vacuum evaporation of a film forming process of the conductive layer. Moreover, in forming the dielectric layer, a thick film material, represented by a low melting point glass, is heated so as to melt.

In forming plural composition elements sequentially on the same substrate, in the prior art, the material and the heat process condition of each composition element were selected so as to allow no influences, such as the deformation or change in quality, on the previously formed composition elements. For example, in the case where the heating is performed two times, the heating temperature of the second time is chosen lower than the heating temperature of the first time; and accordingly, the materials to be heated are chosen to correspond to the required heating temperatures.

In manufacturing PDPs as mentioned above, whenever the composition element is formed the substrate is expanded and contracted. Therefore, in mass-production, most substrates are in a warped state when each panel is finished, even if a smooth substrate is employed for the front panel or the back panel. The warp of the substrate becomes remarkable as the PDP screen size, i.e. the outline dimension of the substrate, becomes larger.

In prior arts, the direction of the warp of the substrate was irregular. That is, sometimes the inner surface on which the composition elements have been formed becomes convex, which is referred to hereinafter as a "warp in a positive direction"; or sometimes, on the contrary, the warp is such that the inner surface becomes concave, which is referred to hereinafter as a "warp in a negative direction". Therefore, there were problems as follows.

FIGS. 1A to 1C schematically illustrate a cross-sectional view of panel shapes in the prior art sealing steps. In FIGS. 1A to 1C, there are partially omitted the composition elements in order to make the figure simple, and the warp of the substrate is exaggerated.

The problem of the prior arts are hereinafter explained together with the procedure of the sealing process. A glass substrate 110 having a display electrode 120 thereon and a glass substrate 210 having plural separator walls 290 thereon are sealed with each other. Prior to the sealing operation, low melting-point glass layers 310 as the sealant are placed on the edges of glass substrate 210, the thickness of the low melting point glass layers 310 being chosen to be higher than the height of separator walls 290.

Glass substrate 110 and glass substrate 210 are stacked with each other as shown in FIG. 1(*a*). The pair of glass substrates 110 & 210 is heated while pressed to each other so that low melting-point glass layer 310 is melted. Subsequently, the substrate temperature is lowered so that glass substrate 110 and glass substrate 210 are sealed with each other as shown in FIG. 1B.

If there is a warp in a negative direction on glass substrate 110 at the time of starting such sealing process, a gap g is undesirably created between separator walls 290 and the inner surface of the glass substrate 110 unless a warp in a positive direction to counter the warp of the glass substrate 110 is on the opposite glass substrate 210 having separator walls 290. In the example of FIGS. 1A and 1B the gap g is created because glass substrate 210 is flat.

When a PDP is completed after a discharge gas is filled therein as shown in FIG. 1(*c*), the warped state is such that the central portion of glass substrate 110 is depressed due to a low internal pressure of about 500 Torr. (=66,700 Pa), which is lower than the standard atmospheric pressure 760 Torr (=101,325 Pa). The gap g does not completely disappear even though the deformation of glass substrate 110 allows the gap to become smaller than that at the beginning of the sealing operation. Therefore, there was a problem in that the display fell into disorder by the generation of so-called cross-talk caused from an excessive spread of the electrical discharge through the gap g between the substrate and the top of separator walls.

Moreover, when the degree of the warp of the glass substrate was large, there was another problem in that the glass substrate cracked at the sealing process, or cracked afterwards during the step of connecting an external driving circuit thereto, that is connection of flexible cable by an application of mechanical pressure thereover.

In addition, even in the case having no gap g, if the PDP is used in an environment where the external air pressure is lower than the standard atmospheric pressure, the center surfaces of glass substrates 110 & 210, defining the panel envelope, projected toward the outside to cause the increase in the substrates' gap, resulting in the gap g between the substrate and the top of separator wall. That is, the problem was also in that the atmospheric pressure range in which the PDP can properly operate was limited.

SUMMARY OF THE INVENTION

It is a general object of the present invention to provide a plasma display panel to accomplish a high quality display, wherein no gap is existing between the top surface of the separator walls and the inner surface of a glass substrate opposing the other, so that the discharge spaces are correctly defined.

It is another object of the present invention to decrease the damages of the substrates so as to raise the yield of the production.

It is a further object of the present invention to expand the range of atmospheric pressure in which the PDP operates correctly.

In a PDP according to the present invention, the front substrate and the back substrate are respectively in a warped state such that a central portion of each substrate projects in a frontwards direction relatively to a peripheral portion of the substrate, so that the front surface is convex.

After the panels are sealed with each other, a stress remains in the substrates such that the two substrates are pressed to each other with an elastic deformation.

In the finished PDP, a height difference of the central portion measured from a central part of a short side of a substrate divided by a longitudinal width of the substrate is preferably less than 0.1% for the front substrate and the back substrate, respectively.

In preparing the two substrates, the front panel and the back panel are respectively warped towards each other so that the facing inner surfaces are convex during the process of being sealed with each other. A height difference ratio of the central portion from a central part of a short side of the back substrate is preferably less than 0.16%. A height difference ratio of the central portion from a central part of a short side of the front substrate is preferably less than 0.06%. A difference of the height difference ratios of the back substrate and the front substrate is preferably in the range from 0 to 0.1 percentage point.

Owing to this remaining stress, the gap between the separator walls and the inner surface of the facing panel is correctly maintained even in an external air pressure lower than the internal pressure of the PDP.

The above-mentioned features and advantages of the present invention, together with other objects and advantages, which will become apparent, will be more fully described hereinafter, with references being made to the accompanying drawings which form a part hereof, wherein like numerals refer to like parts throughout.

A BRIEF DESCRIPTION OF THE DRAWING

FIGS. 1A through 1C schematically illustrate a segmented, cross-sectional view of a prior art PDP, where the warping of the panel is exaggerated;

FIG. 2 schematically illustrates a perspective view of necessary internal parts of a PDP of the present invention;

FIG. 3 schematically illustrates electrode structure of the PDP;

FIGS. 4 schematically illustrates general electrode configuration of the PDP;

FIG. 5 is a flow chart of manufacturing processes of the PDP;

FIG. 6 schematically illustrates a warped state of the panels at a manufacturing step;

FIGS. 7A through 7C schematically illustrate the sealing process of the PDP;

FIGS. 8A through 8D schematically illustrate a method to warp the panel;

FIG. 9 is a temperature profile in accordance with the method shown in FIGS. 8;

FIGS. 10A through 10D schematically illustrate a second preferred embodiment of warping the panel;

FIG. 11 schematically illustrates a warp of a substrate, and paths along which the warp is measured; and FIG. 12 shows experimental data to find preferable conditions.

DETAILED DESCRIPTION OF THE PREFERRED EMBODIMENT

With reference to the figures, hereinafter described are preferred embodiments of the present invention.

Figure 2:
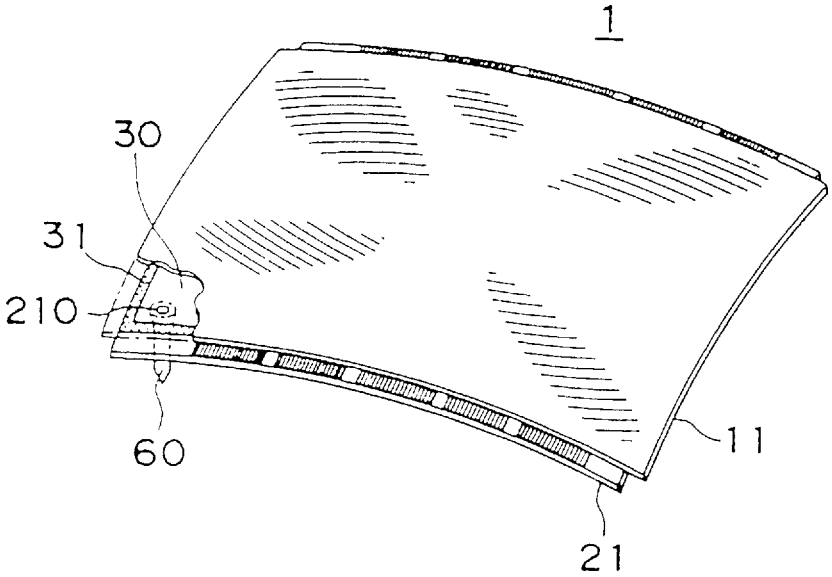

FIG. 2 is a partially notched perspective view of the external appearance showing the warped state of a PDP 1 of the present invention, where the warped state is exaggerated.

In PDP 1, the panel envelope is formed of a pair of glass substrates 11 and 21 which are opposed to each other via discharge spaces 30. These glass substrates 11 and 21 are transparent and rectangular soda lime glass plates of 2.1±0.07 mm in thickness, and are connected with each other by a framed, or peripheral, sealing layer 31 which consists of low melting-point glass arranged on the peripheral edge portions of the mutually opposing areas of the substrates 11 and 12.

On the back glass substrate 21 is provided an exhaust hole 210 of several mm in diameter for filling a discharge gas into discharge spaces 30. And, an exhaust tube 60 is connected to the exit of exhaust hole 210.

Figure 4:
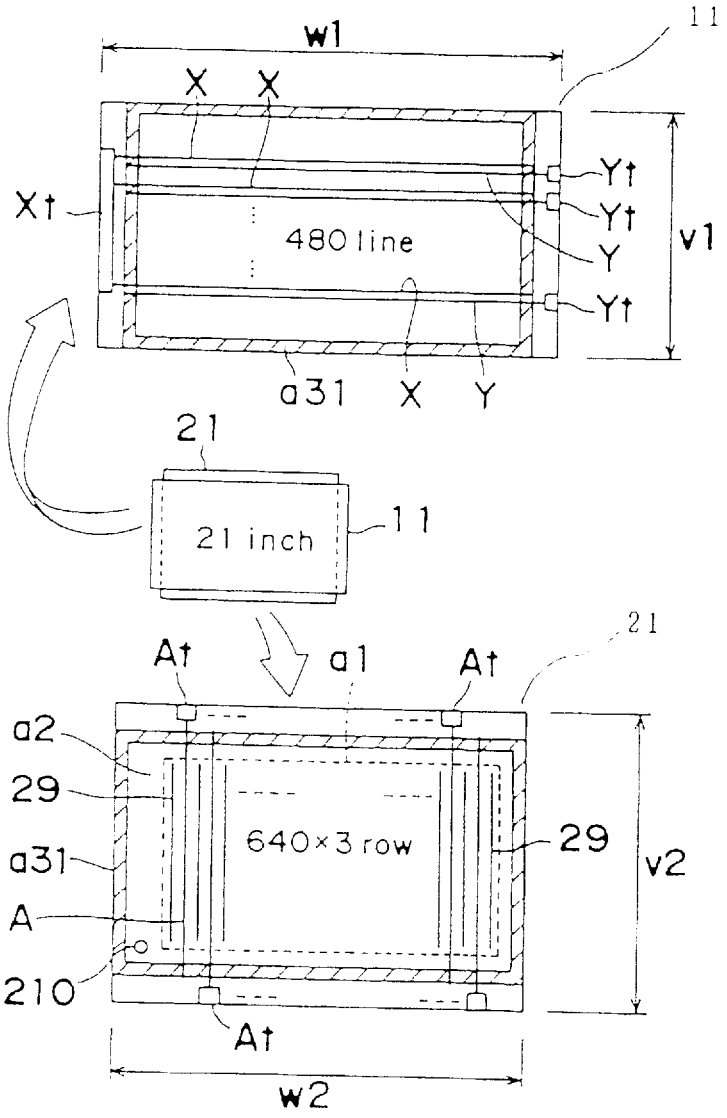

PDP 1 is used while connected with a driving circuit formed on a flexible printed circuit board, which is not shown in the figure. In order to provide an electrical connection of a group of the electrodes to a driving circuit of PDP 1 by means of a flexible printed circuit board, the respective outside dimensions as well as mutual positions of the mutually opposing glass substrates 11 & 21 are chosen so that two mutually opposing sides of glass substrates 11 & 21 extend several mm beyond the edges of two mutually opposing sides of the other glass substrates 21 & 11, respectively, as seen in FIGS. 2 and 4. Concrete values of the external dimension will be shown later.

The feature of external appearance of PDP 1 is such that the glass substrates 11 and 21 are not flat but are warped in a convex shape at the front surface such that the central portion of the PDP projects toward the front viewing side, i.e., in a direction from the back to the front, and thus frontwardly convex. However, the degree of the warp is very minute and the display surface is substantially flat as described later.

Figure 3:
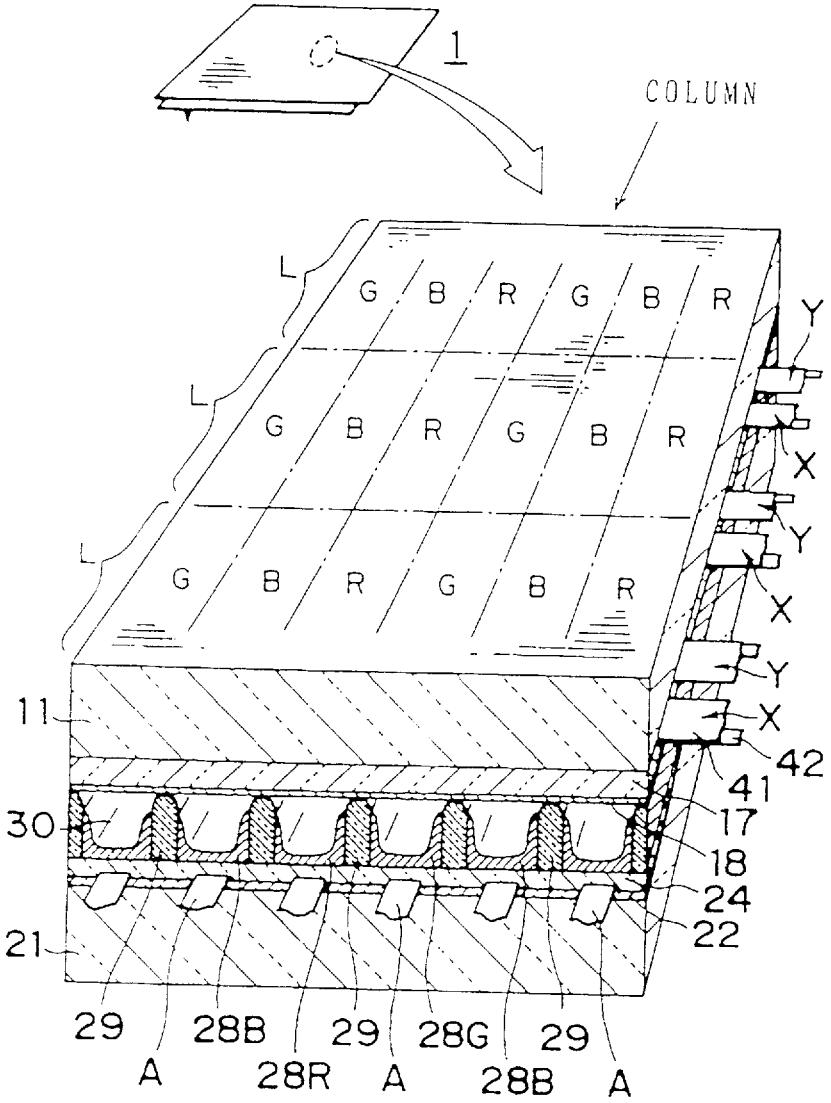

Structure of PDP 1 is hereinafter explained in more detail. FIG. 3 is a perspective view to show an internal structure of a necessary part of PDP 1.

PDP 1 is a surface discharge type PDP of a three—electrode structure of the matrix display type, and is classified as a reflection type according to the arrangement form of the fluorescent materials.

An operating life as long as 10,000 hours or more can be achieved in a displaying color screen, because the surface discharge type PDP can avoid ion bombardment thereonto owing to the widely coated fluorescent material.

On an inner surface of the front glass plate is arranged a pair of straight display electrodes X and Y to cause the surface discharge along the substrate surface for each line L of the matrix display. The line pitch is 660 μm.

Display electrodes X & Y are each respectively formed of a wide and straight transparent electrode 41, which consists of an ITO (indium/tin oxide) thin film, and a narrow and straight bus electrode 42, which consists of a metal thin film, for example Cr/Cu/Cr, of a multi-layer structure.

Table 1 shows an example of the concrete dimensions of transparent electrode 41 and bus electrode 42.

TABLE 1

| | ELECTRODE THICKNESS | WIDTH |
|---|---|---|
| Transparent Electrode | 0.1 μm | 180 μm |
| Bus Electrode | 1 μm | 60 μm |

Bus electrode 42 is a supplementary electrode to secure proper electrical conductivity, and is arranged on a surface of transparent electrode 41 opposite from the discharge gap, and on a side edge of that surface. Such an electrode structures allow an enhancement of the luminous efficiency by the expansion of the surface discharge area while limiting the shading of the display light to a minimum.

In PDP1, a dielectric layer 17 for the AC drive typically formed of a low melting-point glass layer PbO family is provided to insulate display electrodes X & Y from discharge spaces 30.

Figure 6:
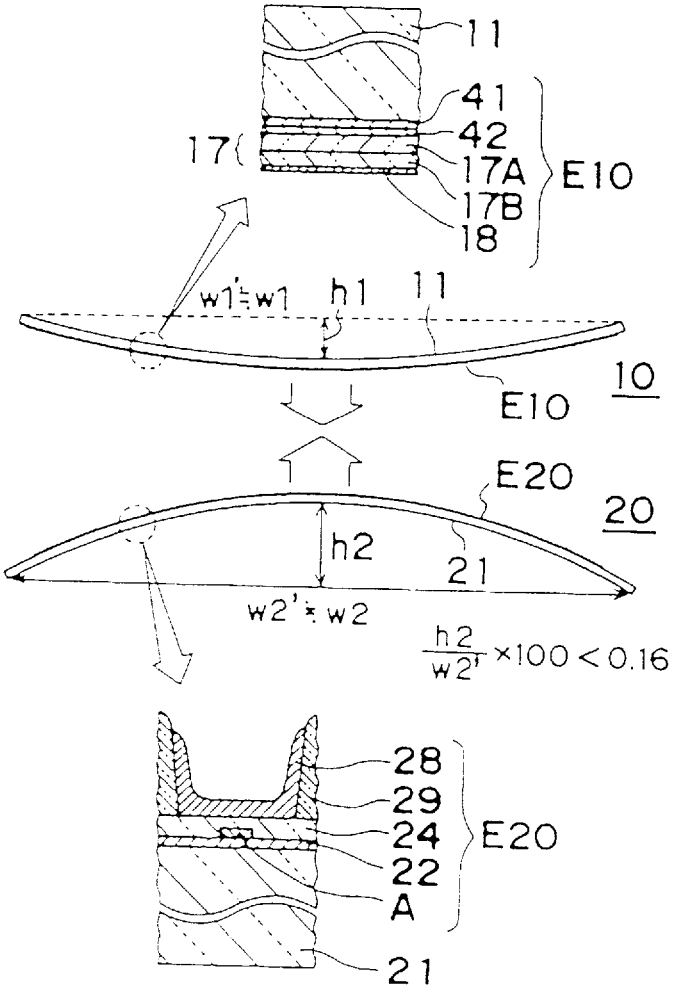

A protection film 18 formed of MgO (magnesium oxide) is vapor-deposited on the surface of dielectric layer 17. Thickness of dielectric layer 17 is about 30 μm. Thickness of protection film 18 is about 5000 Å. Dielectric layer 17 is composed of two layers of a lower dielectric layer 17A and an upper layer 17B, which are of substantially equal thickness as shown in FIG. 6, in order to suppress generation of bubbles as well as to provide a smooth surface.

On the other hand, the inner surface of back glass substrate 21 is uniformly covered with an undercoat layer 22 of about 10 μm in thickness which consists of a low melting—point glass of ZnO family. Address electrodes A are arranged on undercoat layer 22, each spaced by a constant pitch (220 μm) so as to be orthogonal to display electrodes X and Y. Address electrode A is formed by baking a silver paste, where the thickness is about 10 μm. Undercoat layer 22 is to prevent an electromigration of the silver of address electrode A.

The accumulation of the wall charge on dielectric layer 17 is controlled by the electrical discharge between address electrode A and display electrode Y opposing with each other. Address electrode A is covered with a dielectric layer 24 which consists of the low melting point glass of the same composition as undercoat layer 22. Dielectric layer 24 upon address electrode A is about 10 μm thick.

Upon dielectric layer 24 are provided a plurality of separator walls 29, which are viewed straight on a plane, of about 150 μm high, each between adjacent address electrodes A. A main material of separator walls 29 is the low melting point glass, as well. Coloring of separator walls 29 with dark color pigments is effective to improve the contrast of the display. Discharge space 30 is divided by separator walls 29 into each unit luminescent area along the direction of the line (direction of the picture element array parallel to display electrodes X and Y), whereby the gap clearance of discharge space 30 is defined as well.

There are provided fluorescent layers 28R, 28B and 28G, where R, G and B represent three primary colors for a full displaying, i.e. red, green, and blue, respectively, and will be simply denoted hereinafter with 28 when colors need not be specifically distinguished, so as to cover the surfaces of dielectric layer 24 over address electrodes A together with the sides of separator walls 29. These fluorescent layers 28 emit lights by being excited by ultraviolet rays generated by the surface discharge.

In PDP 1, a single picture element (pixel) of the display is composed of three adjacent unit luminescent areas (sub-pixels) in each line L. Thus, the luminescent color in each column is the same for each line.

In PDP1, there is no separator wall that divides discharge space 30 in columnwise direction of the matrix display, that is, in a direction orthogonal to display electrodes X & Y. However, no interference of the discharge takes place between the adjacent lines because the distance 300 μm or more of display electrodes X & Y from the adjacent ones is large enough compared with the surface discharge gap (about 50 μm) of each line L.

FIG. 4 schematically illustrates a general electrode configuration of PDP 1, and an arrangement of each glass substrate 11 and 21, as seen from discharge spaces 30. As is clear from above-mentioned explanation, a single line of the display matrix is formed with a pair of display electrodes X & Y, and a single column corresponds to a single address electrode A; further, sub-pixels on three columns form a single pixel. Specification of the screen of PDP 1 is shown in Table 2.

TABLE 2

| ITEMS | SPECIFICATION |
|---|---|
| SCREEN SIZE | 21 inch (422.4 mm × 316.8 mm) |
| PIXEL QUANTITY | 640 × 480 |
| SUBPIXEL QUANTITY | 1920 × 480 |
| PIXEL PITCH | 660 μm |
| SUBPIXEL PITCH | 220 μm (horizontal) × 660 μm (vertical) |
| PIXEL ARRANGEMENT | R G B R G B |

Upon a peripheral, or frame, area a31, designated with slashes in FIG. 4, is the sealing layer 31 (shown in FIG. 2) where glass substrates 11 and 21 are to be sealed with each other. Width of the slashed frame a31 is 3–4 mm. Assuming that these substrates are flat, the typical sizes are given below, though glass substrates 11 and 21 are somewhat warped as described above.

Front glass substrate 11 is of such dimensions that the horizontal outside dimension w1 (i.e. along the direction of the lines) is 460 mm, and the vertical outside dimension v1

(i.e. along the columnwise direction) is 336 mm, where both of the horizontal ends project outwardly from the sealing area a31 by 7 mm, respectively.

All the display electrodes X are lead out to an edge on a horizontal end of the glass substrate 11, and all the display electrodes Y are lead out to another edge on another end. Display electrodes X are connected all together to a common terminal Xt in order to simplify the driving circuit and, accordingly, are electrically common.

On the contrary, each of the display electrodes Y is independent to provide the line scan of the sequential order of the lines; accordingly, they are individually connected to respective, discrete terminals Yt.

Discrete terminals Yt are divided into, for example, three groups, each of 160 lines, and are connected with driving circuits not shown in the figure via three flexible printed-wiring cables, in each of which the lines in a group are lumped together.

The dimensions of back glass substrate 21 are such that the horizontal outside dimension w2 is 446 mm and the vertical outside dimension v2 along the columnwise direction, i.e. along the address electrode direction, is 350 mm, where both the ends in the vertical direction project outwardly from sealing area a31 by 7 mm, respectively.

Address electrodes A are extended alternately to opposite edges in order to facilitate the terminal arrangement, where each address electrode is connected to a respective discrete terminal at the vertical ends of the glass substrate 21. That is, on both the vertical ends of glass substrate 21 are arranged 960 (=640×3÷2) discrete terminals At corresponding to each address electrode A.

Discrete terminals At thus divided into two groups, each of 960, are further divided into five sub-groups, each of 192. The terminals in each sub-group are concurrently connected in the batch to a driving circuit. That is, flexible printed-wiring cable of 10 (=5×2) pieces in total are connected to the discrete terminals of glass substrate 21 by means of widely known anisotropic conductive film, where a mechanical pressure is applied onto the flexible printed wiring cable so that metallic fillers in the anisotropic conductive film are contacted with each other so as to bridge each of the 192 terminals on the board to the corresponding terminals on the PDP substrate.

The application of the mechanical pressure thus distributed into the subgroups allows shorter width of the flexible printed-wiring cables, whereby breaking of the glass substrate caused from the mechanical pressure application on a wide area is prevented.

Within the sealing area a31, the area in which the discharge cells are determined by display electrodes X & Y and address electrode A is an effective display area a1, that is the screen. Between effective display area a1 and sealing area a31 is provided a non-display area a2 of a framed shape in order to avoid an influence of the outgrassing from the sealant. As for each side of the non-display areas a2, the width of the side having exhaust hole 210 is about 15 mm, and the widths of three other sides are about 4 mm.

Above-mentioned separator walls 29 are to define the discharge spaces in effective display area a1. Accordingly, both the ends of each separator wall 29 are away from sealing area a31 by about 4 mm only. Therefore, the discharge spaces 30 between each separator wall 29 are mutually joined, and can be exhausted as well as filled with the discharge gas through the single exhaust hole 210.

Figure 5:
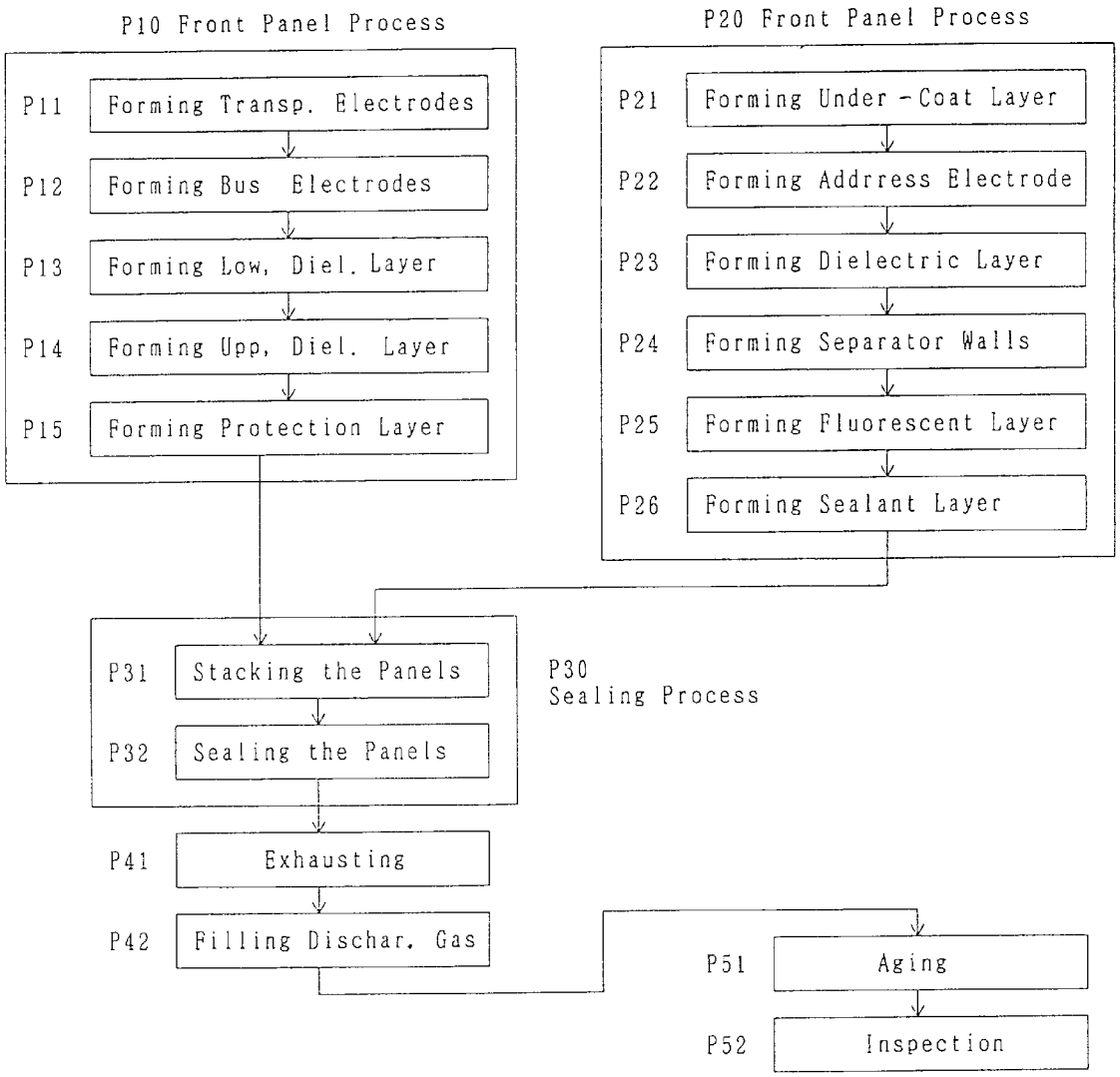
Figure 7A:
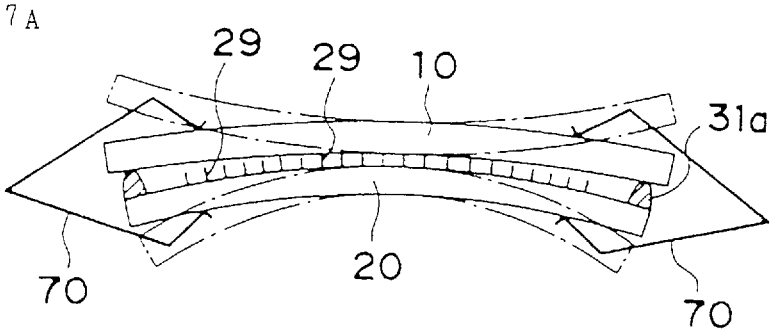
Figure 7B:
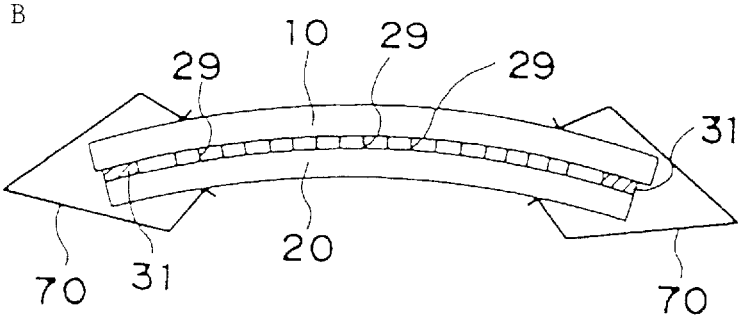
Figure 7C:
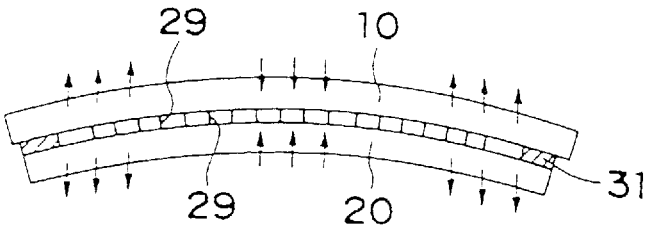

The method of producing PDP 1 of the above-mentioned structure is hereinafter explained. FIG. 5 is a flow-chart showing the production process of PDP 1. FIG. 6 schematically illustrates the warped states during the production. FIGS. 7 schematically illustrate the sealing processes.

In producing PDP 1, a front panel 10, shown in FIG. 6, supported by a glass substrate 11 as a support body is first made in a front panel process P10 (FIG. 5), and a back panel 20 supported by a glass substrate 21 as a support body is manufactured concurrently in a back panel process P20 (FIG. 5).

Next, in a sealing process P30 (FIG. 5) the pair of front panel 10 and back panel 10 is arranged to oppose each other (P31), so that the panel envelope is formed in a sealing process P32 as described below, at which the peripheral (frame) areas of both the panels are sealed with each other.

PDP 1 is completed after sequentially passing an exhaust process (P41) at which an internal impurity gas is exhausted with a vacuum pump, and a process P42 at which a discharge gas, a mixture of neon and a small amount of xenon, is filled therein. Pressure of the discharge gas is about 500 Torr.

On completion of filling the discharge gas, discharge spaces 30 are completely sealed up by tipping off exhaust tube 60; as well as PDP 1 is separated from the external piping system.

For PDP 1 having completed the sealing process, aging process P51 is performed such that the full screen is lit for tens of hours. PDP 1 which passes an inspection P52 afterwards is shipped as a commodity.

Front panel 10 is composed of glass substrate 11 and five structural elements of the first group E10, i.e. transparent electrode 41, bus electrode 42, lower dielectric layer 17A, upper dielectric layer 17B and protection film 18, as shown in FIG. 6. Front panel process P10 is composed of a total of five process steps P11 to 15, respectively corresponding to each of the five structural elements. Transparent electrodes 41 and bus electrodes 42 are patterned by a photolithography method in the lump together with all display electrodes X and Y. Lower dielectric layer 17A and upper dielectric layer 17B are formed by baking low melting-point glass.

Back panel 20 is composed of glass substrate 21 and five structural elements of the second group E20, i.e. substrate layer 22, address electrodes A, dielectric layer 24, separator walls 29 and fluorescent layers 28. Back panel process P20 is composed of five process steps P21 to 25, respectively corresponding to each of the five structure elements, and a process P26 to provide the sealant material 31*a* formed of a low melting point glass layer particular for the sealing, on the sealing area a31.

Baking of the sealant material to de-gas therefrom in process P26 greatly decreases the impurities, such as organic solvents, which may emanate in the following sealing process P30 causing pollution of discharge space 30.

The methods of forming separator walls 29 include a method of printing the low melting-point glass paste in stripes and baking thereof, or a method of printing the low melting point glass paste on the whole surface of the effective display area a1 and afterwards physically or chemically patterning thereof.

The patterning process may be performed after the paste is baked; however, if a sand-blast is employable, it is preferable in the view point of better controlling of the etching that the procedure is such that the paste layer is patterned first in a dry state and afterwards the paste layer is baked. Moreover, it is also possible to bake separator walls 29 at the same time as the baking process of dielectric layer 24.

Fluorescent layers 28 can be easily formed by printing the paste of fluorescent material on a predetermined column, i.e. between the separating walls, for each luminescent color, and baking the paste of the respective three colors all together.

Because fluorescent layers 28 are coated after separator walls 29 are formed, fluorescent layer 28 can be widely coated to include the sides of separator walls 29; accordingly, the brightness of the display can be enhanced.

In manufacturing PDP 1, the material of each composition element and the annealing condition in each process are selected so that the influences, such as the deformation and change in the quality, should not appear to the composition elements formed in the previous process.

The highest temperature in each process is shown in Tables 3 and 4, and the material of glass substrates 11 & 21 in PDP 1 is shown in Table 5.

Compositions of lower dielectric layer 17A, upper dielectric layer 17B, the back panel dielectric materials, i.e. undercoat layer 22 and dielectric layer 24, are collectively shown in Table 6.

TABLE 3

| PROCESS | P11 | P12 | P13 | P14 | P15 | P16 |
|---|---|---|---|---|---|---|
| MAX. TEMP. | 300° C. | 300° C. | 580° C. | 475° C. | 300° C. | 410° C. |

TABLE 4

| PROCESS | P21 | P22 | P23 | P24 | P25 | P26 |
|---|---|---|---|---|---|---|
| MAX. TEMP. | 590° C. | 590° C. | 580° C. | 500° C. | 500° C. | 420° C. |

TABLE 5

| Glass Substrate (Soda Lime Glass) | | |
|---|---|---|
| | Component | Contents (wt %) |
| Composition | $SiO_2$ | 71.0–73.0 |
| | $Na_2O$ | 13.5–15.0 |
| | CaO | 8.0–10.0 |
| | MgO | 1.5–3.5 |
| | $Al_2O_3$ | 1.5–2.0 |
| | $Fe_2O_3$ | 0.025–0.2 |
| Specific Weight | 2.493 | |

TABLE 6

| Contents (wt %) | | | |
|---|---|---|---|
| Component | Lower Diel. Layer | Upper Diel. Layer | Back Panel Diel. Layer |
| PbO | 60–65 | 70 | — |
| $B_2O_3$ | 5–10 | 15 | 10–20 |
| $SiO_2$ | 20–20 | 10 | –5 |
| ZnO | — | 5 | 30–40 |
| CaO | 5–10 | — | 15–20 |
| $BiO_3$ | — | — | 20–30 |
| $Al_2O_3$ | — | — | 10 |
| $ZrO_3$ | — | — | 5–10 |
| MELT' TEMP. | 580° C. | 470° C. | 580° C. |

Of two important points in manufacturing PDPs, the first point is that both front panel 10 and back panel 20 are prepared to be warped intentionally in the positive direction as shown exaggeratedly in FIG. 6 in front panel process P10 and back panel process P20, respectively, where the warp in the positive direction is defined such that the surface, which is to be an inner surface when PDP1 is completed, i.e. on which the structural elements on glass substrates 11 & 21 are formed, is convex. On the other hand, the warp in a negative direction is defined such that the inner surface of glass substrate 11 or 21 is concave.

The second point is that the degree of the warp of back panel 20 is larger than that of front panel 10.

When the degree of the warp of the front panel and that of the back panel are presented, in each use, as a percentage (h1/w1')×100 and (h2/w2')×100 of height differences h1 and h2 of the central convex portion to the periphery, against the horizontal outline dimension w or w', respectively, of the front and rear panels 10 and 20, the preferable amount of the front panel is 0.06% or less. And, as for the back panel it is preferable that warp is in the range 0.06 to 0.16% while the difference between the respective warps of the front and back panels is from 0 to 0.1 percentage points. If the warp of the front panel or the back panel is respectively more than 0.16% or 0.06%, the panel cracks in the sealing process. If the warp difference is less than 0.0 percentage point, the front panel may become concave to cause the discharge spread. If the difference is larger than 0.1 point, the panel may cause a crack. For instance, when the degree of the warp of front panel 10 is selected to be 0.05% the degree of the warp of back panel 20 is selected to be a value within the range of 0.05 to 0.15%.

The outline dimensions w1' & 'W2' are substantially equal to the corresponding outline dimensions w1 & w2 in the flat state, as presented with formula w1'≈w1 and w2≈'w2, because the outline dimensions w1' & 'W2' are the straight distance between both the ends of each glass substrates 11 & 21, and the degree of the warp is only a little.

The above-cited ranges are based on experimental data disclosed later on, with reference to FIG. 12.

Figure 1A:
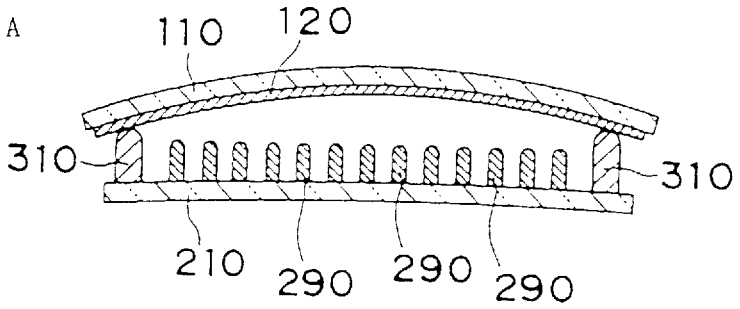
PRIOR ART Fig. 1A
Figure 1B:
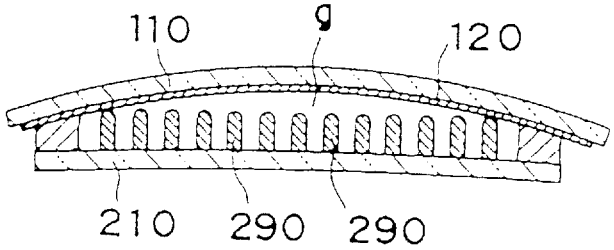
Figure 1C:
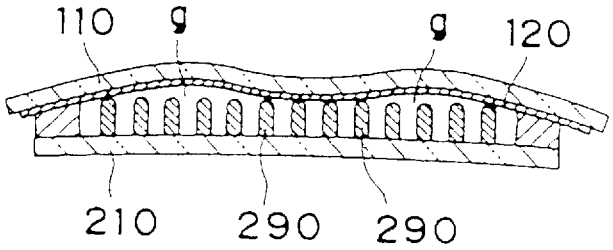

Thus, according to the present invention, a PDP 1 having 0.1% or less of the warp such that the center part projects slightly in a direction from the back to the front side, as shown in FIG. 1, is accomplished by the employment of front panel 10 and back panel 20 warping in the positive direction, respectively. Even when the mechanical pressure is applied onto to the glass substrate for the anisotropic conductive film batch wiring, glass substrate 11 or 21 of thus made PDP 1 does not crack or break owing to the little degree of the warp at the area of the single batch wiring.

Next, the effect of the warp is hereinafter explained. PDPs are structural devices where the front panel and the back panel are sealed with each other at the peripheral area, but the central areas merely touch, without being mechanically connected with each other. Due to such a structure, the intentional warping of both the panels at the step prior to the sealing process contributes to the improvement of reliability.

That is, in sealing process P30, front panel 10 and back panel 20 are stacked so that the two convex surfaces are facing each other as shown with chain lines in FIG. 7(*a*). Then, all the four sides of the panels are pinched by clips 70 so that both the panels are mutually held together. Both the panels are elastically deformed by the pinching force of clips 70, so that front panel 10 changes from the state of the positive warp to the state of the negative warp as shown with the solid lines in FIG. 7(*a*).

This is because, at the step before the stacking process, the degree of the warp of back panel 20 is larger than that of front panel 10. At this time in back panel 20, the degree of the warp in the positive direction has become smaller.

In the step shown with the solid lines in FIG. 7(*a*), in the center portion, separator walls 29 touch front panel while in the peripheral portion, separator walls 29 are away (i.e., displaced) from front panel 10, because the thickness of sealant layer 311a is higher than the height of separator walls 29.

Next, both the panels are heated up to about 410° C. while pinched with clips 70 so as to melt the sealant layer 31*a*. The gap at the peripheral portion are narrowed as sealant layer 31*a* softens. And, all separator walls 29 finally touch front panel 10 as shown in FIG. 7(*b*). Thus, the internal spaces are properly defined by separator walls 29, Next, the temperature of the panels is lowered to an ordinary temperature, i.e. a room temperature, by forced cooling or natural cooling. Then, sealant layers 31*a* are hardened so as to becomes a sealing layer 31 to seal the panels.

After the step to remove clips 70 to finish the sealing process, a stress to recover to the former state before the elastic deformation acts so that the center portions of both the panels are pressed inwardly as shown with arrows in FIG. 7(*c*). This is because the sealing temperature is far below the warped temperature.

Therefore, no outward warp of either of the panels takes place even if PDP 1 is placed in such a low-pressure environment as the atmospheric pressure, which is the same as or lower than the internal pressure, whereby the division of the internal spaces by separator walls 29 is accurately kept.

In principle, before the sealing process the front panel 10 may be flat as long as back panel 20 warps in a positive direction. However, if front panel 10 is warped in the negative direction at the step before the sealing process, a gap may be generated between front panel 12 and separator walls 29 after the sealing process.

Therefore, in order to surely avoid the generation of the gap, both back panel 20 and front panel 10 must be actually warped in the positive direction in the step before the sealing process.

A method according to the present invention to prepare the warped front panel 10 and back panel 20 is hereinafter explained.

FIGS. 8 schematically illustrates a typical method to warp the panels. FIG. 9 is a graph to qualitatively show a profile of baking temperature corresponding to FIG. 8. Though glass substrate 11 for a front panel is typically referred to in FIG. 8, glass substrate 21 can be similarly warped for the back panel, as well.

In the method of FIG. 8, in baking the thick film material such as the low melting-point glass, a support body 90, as a. setter, formed of a material having a thermal expansion coefficient smaller than that of glass substrate 11 is employed. For support body 90, a quartz board, typically of a trade name NEOCERAM NO, which has a thermal expansion coefficient of about $-5\times10^{-7}$/° C., accordingly, shrinks as the temperature rises, is the most suitable. The thermal expansion coefficient of glass substrate 11 is about $90\times10^{-7}$/° C.

A surface S90 of support body 90 is a little etched as to be sufficiently so rough that glass substrate 11 cannot slip on support body 90. Glass substrate 11 is chamfered, where the chamfered surface S1*a* is rough like a ground glass plate.

Figure 8A:
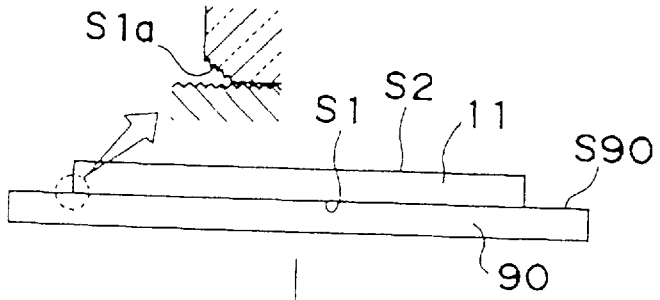
Figure 8B:
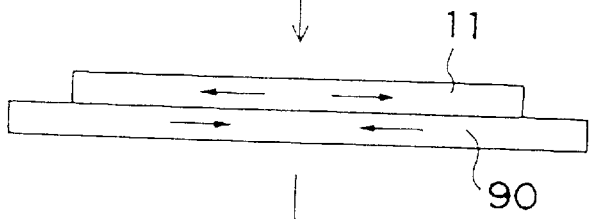
Figure 9:
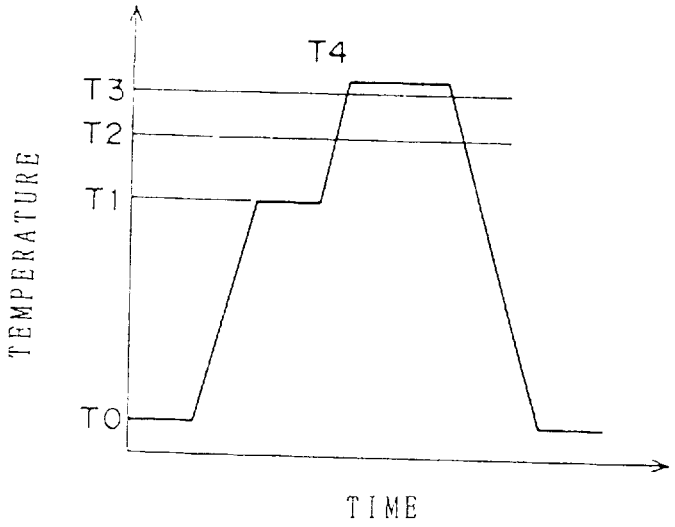

Upon support body 90 is horizontally placed the glass substrate 11, on which thick film material is printed but not shown in the figure, so that surface S1, i.e. the surface to become an outside of PDP 1, is opposed from the printed surface S2, as shown in FIG. 8A.

Support body 90 carrying glass substrate 11 thereon is put into a baking furnace, for instance, of an inline type. As the temperature rises, glass substrate 11 expands and support body 90 relatively shrinks as shown with the arrows in FIG. 8B. When above-mentioned quartz board is used for the support body 90, support body 90 actually shrinks.

Figure 8C:
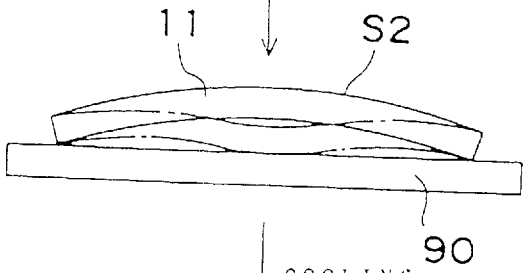

Therefore, when a slip between glass substrate 11 and support body 90 is thus prevented, glass substrate 11 warps in the positive direction, that is the printed surface S2 becomes convex as shown with solid lines in FIG. 8C.

In baking the low melting-point glass, the heating process is carried out generally in two steps as shown in FIG. 9. That is, at first the temperature is raised from room temperature T™ to a predetermined temperature T1; next, temperature T1 is maintained for a predetermined fixed time so as to evaporate the binder of the paste. Next, the temperature is raised from temperature T1 to a temperature T4 which exceeds a softening point T2 of the low melting-point glass so as to adequately melt the low melting point glass; and subsequently cooled.

Figure 8D:
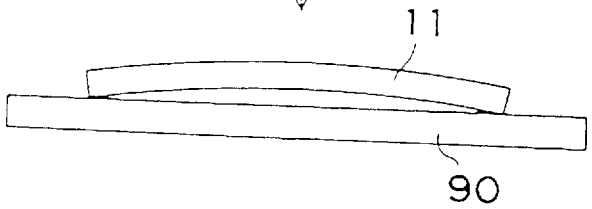

In such a temperature profile, the highest temperature T4 for the baking is set in the vicinity of deformation point T3 of glass substrate 11. Accordingly, the stress generated in glass substrate 11 by warping due to the thermal expansion is decreased, that is annealed. If the cooling operation is performed after the stress is annealed, glass substrate 11 does not return to its state previous to the heating operation, but becomes a state such that it remains warped in the positive direction as shown in FIG. 8D. That is, the method of FIG. 8 is such a method that glass substrate 11 is warped by the use of non-reversibility of the heat expansion/contraction in the glass material.

Deformation point T2 of glass substrates 11 and 21 having the composition shown in Table 5 is about 570°–590° C. Therefore, in manufacturing PDP 1 the method of FIG. 8 can be applied to the process P13 for forming the lower dielectric layers 17A and to the process P23 for forming dielectric layer 24 on the back panel.

If glass substrate 11 or 21 is excessively heated, the glass substrates deforms by its own weight as shown with chains in FIG. 8C. That is, the desired warp is not achieved. Therefore, it is important to design the temperature profile in consideration of this respect.

FIGS. 10A to 10D schematically illustrate a second preferred embodiment of the warping method. Though front glass substrate 11 is referred to in FIGS. 10, back glass substrate 21 can be warped in the similar way, as well.

In the method of the second preferred embodiment, a material having a smaller thermal expansion coefficient than that of each of the glass substrate 11 and 21 is employed for the widely spreading uniform thick film material such as dielectric layer 17 or 24. Thermal expansion coefficient of the material of the composition of Table 6 is within the range of $70\times10^{-7}$/° C. to $80\times10^{-7}$/° C.

Figure 10A:
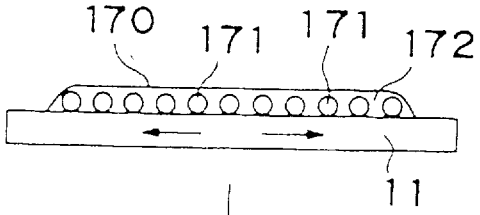

In forming, for instance, the lower dielectric layer 17A, a paste 170 which is a mixture of low melting point glass powder 171 and binder 172 is printed on glass substrate 11; next, the glass substrate 11 is carried into the baking furnace so as to heat paste 170 as shown in FIG. 10A. As the temperature rises, the glass substrate 11 expands.

Figure 10B:
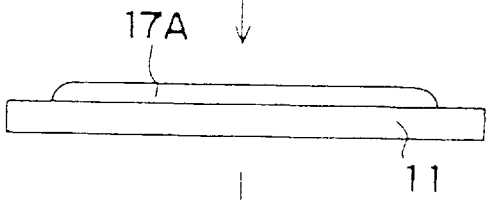
Figure 10C:
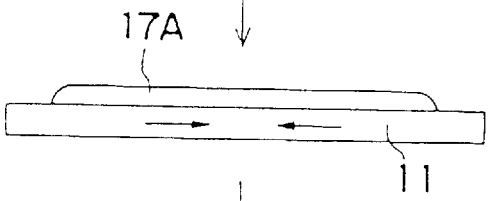
Figure 10D:
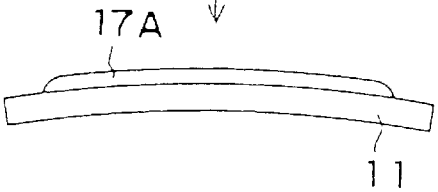

At the initial step of the baking operation, glass substrate 11 expands substantially freely because individual particles of low melting-point glass powder 171 are distributing in binder 172. As binder 172 evaporates, low melting-point glass powder 171 melts so as to form the lower dielectric layer 17A as shown in FIG. 10B. In the subsequent cooling step, glass substrate 11 and the lower dielectric layer 17A contract as shown in FIG. 10C. At this time, glass substrate 11 warps in the positive direction as shown in FIG. 10D. because the degree of the contraction of glass substrate 11 is larger than that of lower dielectric layer 17A caused from the difference of the thermal expansion coefficient of lower dielectric layer 17A.

Though two methods for warping the panels have been disclosed above, there is still another method as a third preferred embodiment, in which a temperature distribution is provided along the direction of the thickness of glass substrate 11 or 21 during the cooling operation. That is, after the lower surface of glass substrate 11 or 21 is quickly cooled so as to contract, the substrate is slowly cooled together with the melted layer. Thus, glass substrate 11 or 21 having a warp resulted from the quick cool is accomplished.

In manufacturing PDP 1, the conditions for front panel process P10 and back panel process P20 are chosen so as to obtain the panels having the above-mentioned proper warps by suitable combination of the three above-mentioned methods. Each of the three methods can be selectively combined for use in the formation of a single composition element, such as lower dielectric layer 17A or dielectric layer 24.

The above-described preferable ranges of the warp are determined in accordance with the results of experimental data disclosed below.

Figures 11, 12:
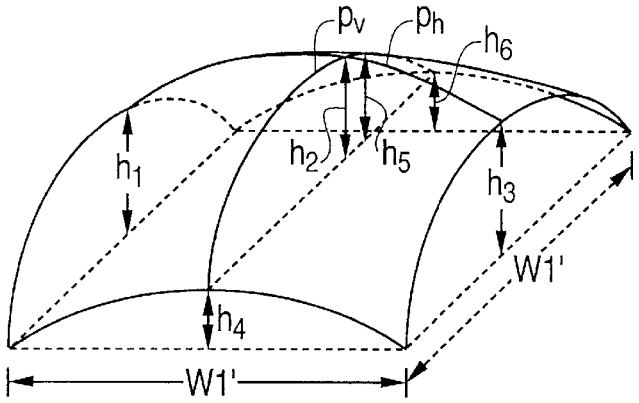

FIG. 11 schematically illustrates an exaggerated shape of a warped substrate and the paths $P_h$ & $P_v$ along which the surface heights were measured. Each path starts from a center, where the heights are $h_1$ or $h_4$, of a side of the substrate to travel along respective paths to the respective opposite side, where the heights are $h_3$ or $h_6$. Thus, the starting points of the paths are already deviated from a line connecting four corners of the substrate. The heights h2 & h5 respectively of the horizontal path and the vertical path, become equal if the warp is symmetric. The heights are measured with a dial gauge, which is not shown in the figure, while traveling along the above-described paths. Thus measured height measured along the path $P_h$ horizontally passing the central portion are shown in FIG. 12. The percentage of the height is for the horizontal width w1'.

Thus, after the substrates are sealed with each other, if the warp of the front panel is convex toward the front side a gap is not caused between the upper surface of each separator wall and the opposing inner surface in a same way as the case where both the substrates are flat, resulting in correctly defined discharges.

Alternatively, both the substrates may warp backwardly (i.e., be backwardly convex, thus frontwardly concave) the view point of controlling the gap. However, in consideration of the visual field angle of the display, the convex viewing surface is more preferable than the concave viewing surface.

A stress remains in the substrate such that the respective center portions are pressed to each other by an elastic deformation of the glass substrates keeps the accurate contact of the separator walls onto the inner surface of the opposing panel even if the external air pressure is lower then the inner pressure of the PDP.

According to the above-mentioned preferred embodiments, owing to the simply warped front surface having the projected center portion and the front appearance similar to a CRT, a display device having none of incompatibility with the conventional acceptance can be accomplished.

In the above-mentioned preferred embodiments, the structure of PDP 1, including the size, the material, shape, and the formation method etc. of the composition elements may be variously modified. For instance, address electrode A formed of the baked silver paste can be replaced with a thin film electrode so as to omit under coat layer 22.

Moreover, it is also possible to omit dielectric layer 24 on the back panel according to the design policy.

Though in the above preferred embodiments the respective thicknesses of the front and back substrates are referred to to be equal, it is apparent that the concept of the present invention can be applied to the case where the respective thicknesses are not equal.

According to the above-mentioned preferred embodiments, the accurate contact between the separator walls to the surface of the opposing panel allows the perfect division of spaces 30 by separator walls 29; accordingly, a high quality display having no cross-talk of colors can be achieved in the simply structured PDP 1 having straight separator walls 29 on a back panel 20, only.

Owing to the warp being controlled to lower, or less, than a limiting value, the damage of the substrate in connecting an outside driving circuit thereto can be decreased so that the productivity of the plasma display panel can be improved.

A cross-talk, i.e. an undesirable impurity, of the lit colors caused from excessive spread of the discharges through the gap between the separator walls and the facing substrate into the adjacent discharge space can be decreased so that the high quality in colors can be achieved.

Owing to the present invention, a plasma display panel larger than 21 inches first has come to be realized.

The many features and advantages of the invention are apparent from the detailed specification and thus, it is intended by the appended claims to cover all such features and advantages of the methods which fall within the true spirit and scope of the invention. Further, since numerous modifications and changes will readily occur to those skilled in the art, it is not detailed to limit the invention and accordingly, all suitable modifications are equivalents may be resorted to, falling within the scope of the invention.

What I claim is:

1. A method of manufacturing a plasma display panel, an external envelope of the plasma display panel being formed of a front substrate and a back substrate, the front substrate and the back substrate being opposing each other via discharge space and a plurality of separator walls mutually in parallel, said separator walls defining the discharge spaces in a pixel array, the method comprising:

a front panel process for making a front panel, a first group panel-constitutional elements being formed upon a first surface of said front substrate, said front panel process comprising a step for warping said front substrate by heating said front substrate so that a central portion of said front substrate protrudes toward said first surface of said front substrate;

a back panel process for making a back panel, a second group panel-constitutional elements being formed upon a first surface of said back substrate, said back panel process comprising a step for warping said back substrate by heating said back substrate so that a central portion of said back substrate protrudes toward said first surface of said back substrate;

a sealing process for sealing peripheral edge portions of the opposing areas of said front panel and said back panel by a heating process while said first surfaces of both said front panel and said back panel are facing each other and are pressed to each other, and while at an elastic deformation such that a stress is generated so as to press said central portions of said front panel and said back panel toward each other.

2. A method as recited in claim 1, wherein a degree of the warp of said back panel at the end of said back panel process is larger than the degree of the warp of said front panel at the end of said front panel process.

3. A method as recited in claim 2, wherein a height difference ratio of said central portion from a, central part of a short side of the back substrate for a longitudinal width is less than 0.16%.

4. A method as recited in claim 3, wherein a difference of said height difference ratios between said back panel and said front panel is less than 0.1 percentage point.

5. A method as recited in claim 3, said front panel process comprises the steps of:

placing said front substrate directly upon a processor plate having a thermal expansion coefficient smaller than a thermal expansion coefficient of said front substrate; and warping said front panel, while kept as placed, by heating said front panel and said processor plate; and said back panel process comprises the steps of:

placing said back substrate directly upon a processor plate having a thermal expansion coefficient smaller than a thermal expansion coefficient of said back substrate; and warping said back substrate, while kept as placed, by heating said back substrate and said processor plate.

6. A method as recited in claim 3, wherein said front substrate is a glass plate, said front panel process comprises the steps of:

placing said glass plate directly upon a processor plate having a thermal expansion coefficient smaller than a thermal expansion coefficient of said glass plate; and heating said glass plate together with said processor plate, while kept as placed, as high as close to a deformation point of said glass plate, whereby said glass plate is warped as well as an internal stress in said glass plate is reduced; and next, lowering the temperature of said glass plate and said processor plate.

7. A method as recited in claim 6, wherein said back substrate is a glass plate, said back panel process comprises the steps of:

placing said glass plate directly upon a processor plate having a thermal expansion coefficient smaller than a thermal expansion coefficient of said glass plate; and heating said glass plate together with said processor plate, while kept as placed, as high as close to a deformation point of said glass plate, whereby said glass plate is warped as well as an internal stress in said glass plate is reduced; and next, lowering the temperature of said glass plate and said processor plate.

8. A method as recited in claim 3, wherein said back substrate is a glass plate, said back panel process comprises the steps of:

placing said glass plate directly upon a processor plate having a thermal expansion coefficient smaller than a thermal expansion coefficient of said glass plate; and heating said glass plate together with said processor plate, while kept as placed, as high as close to a deformation point of said glass plate, whereby said glass plate is warped as well as an internal stress in said glass plate is reduced; and next, lowering the temperature of said glass plate and said processor plate.

9. A method as recited in claim 2, wherein a height difference ratio of said central portion from a central part of a short side of the front substrate for a longitudinal width is less than 0.16%.

10. A method as recited in claim 9, wherein a difference between said respective height difference ratios of said back panel and said front panel is less than 0.1 percentage point.

11. A method as recited in claim 2, said front panel process comprises the steps of:

placing said front substrate directly upon a processor plate having a thermal expansion coefficient smaller than a thermal expansion coefficient of said front substrate; and warping said front panel, while kept as placed, by heating said front panel and said processor plate; and said back panel process comprises the steps of:

placing said back substrate directly upon a processor plate having a thermal expansion coefficient smaller than a thermal expansion coefficient of said back substrate; and warping said back substrate, while kept as placed, by heating said back substrate and said processor plate.

12. A method as recited in claim 2, wherein said front substrate is a glass plate, said front panel process comprises the steps of:

placing said glass plate directly upon a processor plate having a thermal expansion coefficient smaller than a thermal expansion coefficient of said glass plate; and heating said glass plate together with said processor plate, while kept as placed, as high as close to a deformation point of said glass plate, whereby said glass plate is warped as well as an internal stress in said glass plate is reduced; and next, lowering the temperature of said glass plate and said processor plate.

13. A method as recited in claim 12, wherein said back substrate is a glass plate, said back panel process comprises the steps of:

placing said glass plate directly upon a processor plate having a thermal expansion coefficient smaller than a thermal expansion coefficient of said glass plate; and heating said glass plate together with said processor plate, while kept as placed, as high as close to a deformation point of said glass plate, whereby said glass plate is warped as well as an internal stress in said glass plate is reduced; and next, lowering the temperature of said glass plate and said processor plate.

14. A method as recited in claim 2, wherein said back substrate is a glass plate, said back panel process comprises the steps of:

placing said glass plate directly upon a processor plate having a thermal expansion coefficient smaller than a thermal expansion coefficient of said glass plate; and heating said glass plate together with said processor plate, while kept as placed, as high as close to a deformation point of said glass plate, whereby said glass plate is warped as well as an internal stress in said glass plate is reduced; and next, lowering the temperature of said glass plate and said processor plate.

15. A method as recited in claim 1, said front panel process comprises the steps of:

placing said front substrate directly upon a processor plate having a thermal expansion coefficient smaller than a thermal expansion coefficient of said front substrate; and warping said front panel, while kept as placed, by heating said front panel and said processor plate; and said back panel process comprises the steps of:

placing said back substrate directly upon a processor plate having a thermal expansion coefficient smaller than a thermal expansion coefficient of said back substrate; and warping said back substrate, while kept as placed, by heating said back substrate and said processor plate.

16. A method as recited in claim 1, wherein said front substrate is a glass plate, said front panel process comprises the steps of:

placing said glass plate directly upon a processor plate having a thermal expansion coefficient small than a thermal expansion coefficient of said glass plate; and heating said glass plate together with said processor plate, while kept as placed, as high as close to a deformation point of said glass plate, whereby said glass plate is warped as well as an internal stress in said glass plate is reduced; and next, lowering the temperature of said glass plate and said processor plate.

17. A method as recited in claim 16, wherein said back substrate is a glass plate, said back panel process comprises the steps of:

placing said glass plate directly upon a processor plate having a thermal expansion coefficient smaller than a thermal expansion coefficient of said glass plate; and heating said glass plate together with said processor plate, while kept as placed, as high as close to a deformation point of said glass plate, whereby said glass plate is warped as well as an internal stress in said glass plate is reduced; and next, lowering the temperature of said glass plate and said processor plate.

18. A method as recited in claim 6, wherein said back substrate is a glass plate, said back panel process comprises the steps of:

placing said glass plate directly upon a processor plate having a thermal expansion coefficient smaller than a thermal expansion coefficient of said glass plate; and heating said glass plate together with said processor plate, while kept as placed, as high as close to a deformation point of said glass plate, whereby said glass plate is warped as well as an internal stress in said glass plate is reduced; and next, lowering the temperature of said glass plate and said processor plate.

19. A method of manufacturing a plasma display panel, comprising the steps of:

preparing a front substrate and a back substrate, one of said substrates having a plurality of parallel separator walls disposed on a surface thereof, said separator walls being of a substantially common height;

stacking said front and back substrates, each substrate being warped such that a central part of one substrate projects towards a corresponding central part of the other substrate; and sealing said front substrate and said back substrate to each other via a sealant wall at peripheral sides of said substrates so that the sealed substrates are warped in a common direction.

20. The method as recited in claim 19, wherein the common direction in which said sealed front and back substrates are warped is from said back substrate toward said front substrate.

21. The method as recited in claim 19, wherein the common direction in which said sealed substrates are warped produces a convex exposed surface of said front substrate.

22. The method as recited in claim 19, wherein the common direction in which said sealed front and back substrates are warped is from said front substrate toward said back substrate.

23. The method as recited in claim 19, wherein the common direction in which said sealed substrates are warped produces a convex exposed surface of said back substrate.

24. A method of manufacturing a plasma display panel, comprising the steps of:

forming first and second substrates, each having a main surface bounded by a periphery disposed in a corresponding plane, the main surface of one of the substrates being warped so as to protrude from the corresponding plane of the periphery thereof and one of said first and second substrates having formed thereon a plurality of separator walls of a substantially common height and having respective, exposed top surfaces;

stacking the first and second substrates with the respective main surfaces thereof in opposed relationship and such that the protruding central portion of the main surface of the one substrate projects toward the main surface of the other substrate; and engaging the respective peripheries of the first and second substrates and sealing the engaged peripheries, producing stresses in at least one of the first and second substrates urging the respective top surfaces of the plurality of separator walls against the opposed main surface of the other of the first and second substrates.

25. The method as recited in claim 24, wherein the step of engaging the respective peripheries further comprises reducing the extent of warp of the main surface of the one substrate and producing said stresses therein.

26. The method as recited in claim 24, further comprises:

forming each of the first and second substrates to have respective central portions which are warped and protrude in a common first direction from the corresponding planes of the respective peripheries thereof;

stacking the first and second substrates with the respective main surfaces thereof in opposed relationship and such that the respective, warped central portions thereof protrude toward each other; and said step of engaging the respective peripheries further comprises reversing the first direction of warp of the respective central portion of one of the first and second substrates to a second, opposite direction of warp, to the first direction of the other of the first and second substrates.

27. The method as recited in claim 26, wherein the first and second substrates respectively comprise front and back substrates and the step of forming further comprises:

forming the front substrate to have an extent of warp in the first direction which is less than the extent of warp in the first direction of the central portion of the back substrate;

stacking the front and back substrates with the respective main surfaces thereof in opposed relationship and such that the respective, warped central portions thereof protrude toward each other; and said step of engaging the respective peripheries further comprises reversing the first direction of warp of the respective central portion of the front substrate so as to produce an exposed, convex configuration thereof.

28. The method as recited in claim 24, wherein the first and second substrates respectively comprise front and back substrates and the step of forming further comprises:

forming the back substrate to have an extent of warp in the first direction which is less than the extent of warp in the first direction of the central portion of the substrate; and said step of engaging the respective peripheries further comprises reversing the first direction of warp of the central portion of the back substrate to a second, opposite direction and such that the central portion of the front substrate maintains a concave configuration.

* * * * *

UNITED STATES PATENT AND TRADEMARK OFFICE

CERTIFICATE OF CORRECTION

PATENT NO. : 5,846,110
DATED : December 8, 1998
INVENTOR(S) : Shinji KANAGU et al.

It is certified that error appears in the above-identified patent and that said Letters Patent is hereby corrected as shown below:

On the Title Page, [57] Abstract, lines 6-8, delete the paragraph break.

Col. 15, line 11, delete ",".

Col. 17, line 20, change "small" to --smaller--.

Signed and Sealed this

Fifteenth Day of June, 1999

*Attest:*

Q. TODD DICKINSON

*Attesting Officer*

*Acting Commissioner of Patents and Trademarks*